United States Patent [19]

Astrom

[11] 4,014,296

[45] Mar. 29, 1977

[54] PLANT FOR BURNING FUELS PRODUCING A LIQUID COMBUSTION RESIDUE

[75] Inventor: Ingmar Astrom, Stenungsund, Sweden

[73] Assignee: Gotaverken Angteknik AB, Goteborg, Sweden

[22] Filed: Sept. 30, 1975

[21] Appl. No.: 618,161

[30] Foreign Application Priority Data

Oct. 23, 1974 Sweden ..... 7413315

[52] U.S. Cl. ..... 122/235 P; 110/165 R; 122/7 C

[51] Int. Cl.[2] ..... F22B 21/00; F23G 7/04

[58] Field of Search ..... 122/7 C, 235 R, 235 B, 122/235 P, 235 N; 110/165 R

[56] References Cited

UNITED STATES PATENTS

| | | | |
|---|---|---|---|
| 2,709,424 | 5/1955 | Sifrin | 122/235 |
| 2,911,284 | 11/1959 | Hochmuth | 122/7 |
| 2,982,265 | 5/1961 | Wedertz | 122/235 P |
| 3,403,642 | 10/1968 | Parkin | 122/7 X |

FOREIGN PATENTS OR APPLICATIONS

| | | | |
|---|---|---|---|
| 1,124,941 | 7/1956 | France | 122/235 |

*Primary Examiner*—Kenneth W. Sprague
*Attorney, Agent, or Firm*—Holman & Stern

[57] ABSTRACT

A waste liquor recovery furnace includes a lower combustion chamber and an upper final combustion chamber, separated by a restricted gas passage. The furnace has a basically cylindrical configuration, being defined by a tube membrane shell, and the lower combustion chamber is formed by tubes from said shell being bent, doubly inwards, defining a discharge opening for the liquid combustion residue. A screen of tubes in the final combustion chamber is arranged to direct the gases towards the shell, being substantially solid in the center of the chamber, directly above the discharge opening.

5 Claims, 4 Drawing Figures

PLANT FOR BURNING FUELS PRODUCING A LIQUID COMBUSTION RESIDUE

FIELD OF THE INVENTION

The present invention pertains to plants for the burning of fuels which produce a liquid combustion residue, in the first hand recovery furnace for the burning of black, or waste, liquor.

BACKGROUND OF THE INVENTION

The liquid residue, as well as the combustion gases are highly corrosive and dangerous to the walls of the furnace. The tendency is towards higher steam pressure and higher temperature, whereby the risk for corrosion attacks will increase. The primary combustion occurs under reducing conditions, which imparts certain requirements upon the shape of the combustion chamber, and upon the arrangements for the supply of combustion air.

There will always be a certain amount of said particles in the arising combustion gases, and these particles will adhere to the heat exchange surfaces of the convection part of the boiler, clogging these surfaces. When the plant is shut down for surveying the furnace dropping lumps of such particles is an obvious danger.

The aim of the present invention is to provide a plant, suited to burn waste liquor and similar fuels producing a liquid combustion residue, which is advantageous with respect to manufacture and safe with respect to corrosion, and combines high combustion capacity with favourable combustion properties, and which further permits repair and upkeep to be performed under safe conditions.

SUMMARY OF THE INVENTION

A furnace for the burning of fuels of the type mentioned above is defined by a tube-membrane shell formed by water cooled tubes, interconnected by welded fins and is characterized in that the furnace has a basically circular cross section and a vertical axis, and includes a lower furnace chamber and an upper final combustion chamber, where at least the upper part of the lower furnace chamber has a truncated conical shape and that its bottom is formed by the tube shell tubes being bent to run radially so a central discharge opening is formed, that the final combustion chamber merges into the lower combustion chamber by way of a portion which at least in its lowermost part, is shaped like a reversed, truncated cone, whereby a restricted gas passage will be formed between the lower combustion chamber and the final combustion chamber and that further heat absorbing surfaces, formed by groups of tubes are located within the final combustion chamber, of which groups one forms a screen just upstream of said restricted gas passage, the tubes of said screen being sparse along the shell of the final combustion chamber, but very close together in the centre thereof, just above the discharging opening.

DESCRIPTION OF SOME PREFERRED EMBODIMENTS

Figure 1:
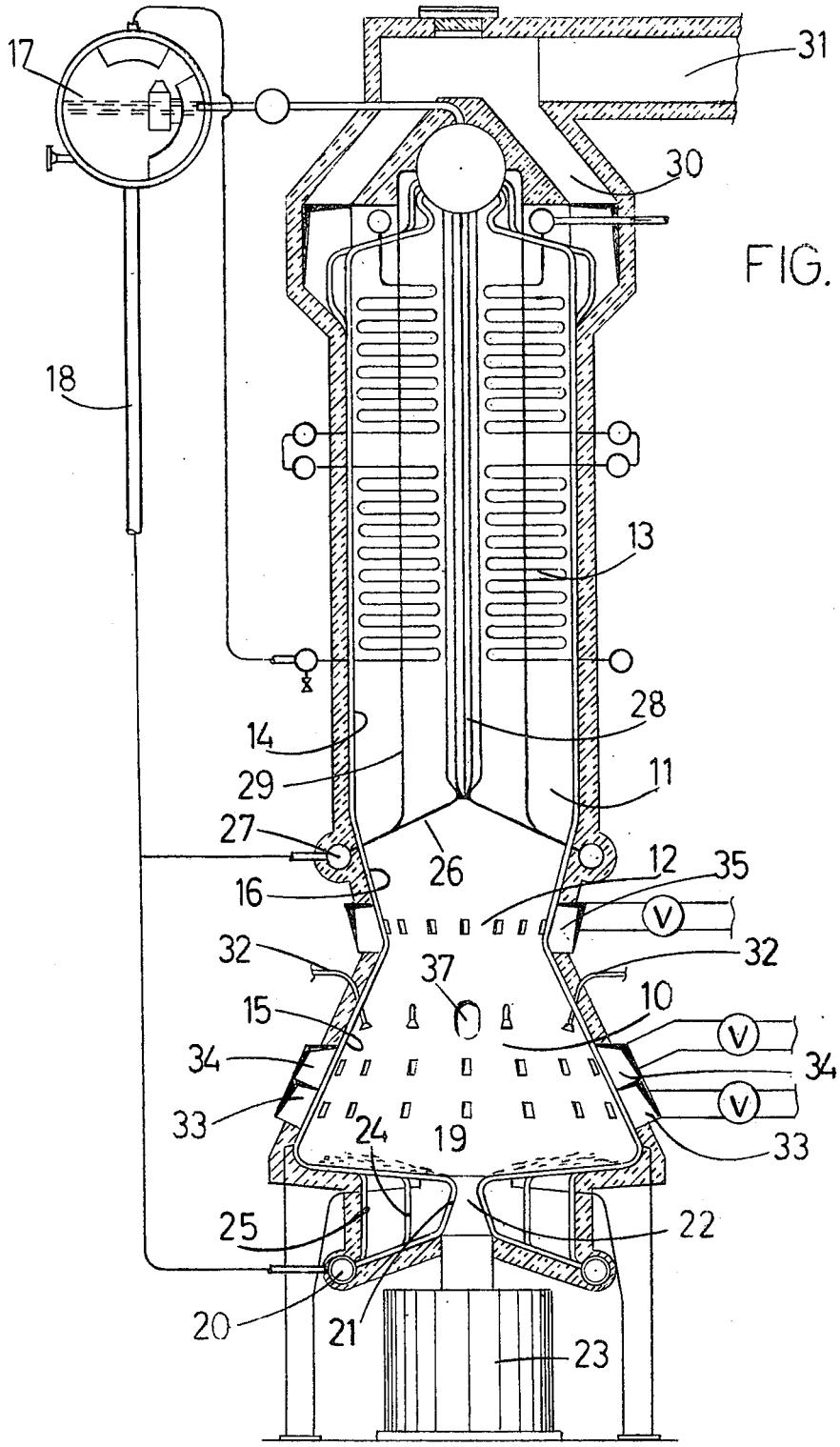
FIG. 1 is a vertical section through a recovery furnace suitable for the combustion of waste liquor, FIG. 2 schematically shows the lower portion of a furnace of a somewhat modified design, FIG. 3 in a horizontal section shows the paths of the jets of liquor and air within the combustion chamber.

The recovery furnace shown in FIG. 1 is of a vertical type, having a basically cylindrical shape and forms part of a steam boiler. The furnace includes a lower combustion chamber 10, in which the primary combustion occurs, and a final combustion chamber 11, which is connected to the lower combustion chamber by way of a restricted throat 12, and within which heat absorbing surfaces, including a superheater 13, are located.

The envelope wall of the two combustion chambers is formed by a membrane shell 14 built up of water cooled tubes interconnected by welded fins, said tubes being bent so the desired shape of the lower combustion chamber and the restricted throat is obtained. In this embodiment the lower combustion chamber is largely shaped as a truncated cone 15, and the lower part of the final combustion chamber is formed as a reversed, truncated cone 16. The top sections of the two cone trunks have the same diameter, and are aligned, forming together the restricted throat 12.

The steam generating part of the boiler includes a steam drum 17, from which down-comer tubes 18 extend downwards, and supply the membrane shell, as well as further tubes with water.

It is important that the bottom of the furnace is effectively cooled, and the tubes of the membrane shell continue inwards and form a bottom structure 19, which is slightly inclined towards the centre of the furnace.

Some of the down-comer tubes 18 are connected to a lower distribution header 20, from which a first group of tubes 21 emanates. These tubes are brought radially inwards, towards the centre of the furnace, and are bent about 180° backwards, and are then brought out again to the envelope wall. In doing so these tubes will form a frame-work supporting the bottom structure. The hair-pin bends of these tubes will, between themselves, define a discharge opening 22 for the molten, liquid combustion residue. Contrary to the custom with recovery furnaces of conventional type no pool of molten residue is formed. Such a pool will have a considerable weight, and means an undersirable load upon the bottom structure. The liquid residue is here permitted continuously to flow out into a dissolving tank 23 located directly below the discharge opening.

The distance between the tubes will of course increase in the direction outwardly from the centre, and in order to obtain a satisfactory strength in the bottom structure, a second group of tubes 24 is arranged in such a manner that the tubes thereof will project inwards, between the tubes 21 of the first group. The tubes of the second group are, however, bent over further away from the centre of the furnace, than the tubes of the first group.

Depending upon the size of the furnace, several groups of tubes may have to be arranged in this manner, the bends of these tubes being located radially outward of each other. In this particular embodiment, a third group of tubes 25 is included, filling the gaps between the other tubes close by the furnace wall.

Also within the bottom structure the tubes are interconnected by welded fins, and the membrane wall is, in the usual manner, protected by means of fire resistant blocks or other covering, to the extent desirable with respect to the risk for corrosion.

Within the final combustion chamber 11 there is a screen of tubes 26, downstream of the super-heater 13. These tubes emanate from an annular distribution header 27, connected to some down-comer tubes 18, and include a first group, where the tubes are directed radially inwards, towards the centre of the chamber, where they are brought together to form a pillarlike structure 28, directly above discharge opening 22, said pillar being practically solid with respect to gas passage.

The temperature of the gases at the lower end of this pillar is so high, that no accumulation of solid deposits will occur. Should such deposits be formed there is an apparent risk that they would drop directly into the dissolving tank, which could cause trouble. The falling drops of liquid residues will now be caught by the arising combustion gases, and be carried outwards to the membrane wall.

As is the case in the bottom structure, the distance between the individual tubes will increase with the distance away from the centre of the chamber. A second group of tubes 29 is therefore arranged to project between the tubes of the first group. In this manner, screen 26 will be substantially solid in its central part, and the passage areas between the tubes will increase in the outwardly direction, which aids in directing the gases towards the membrane shell.

This tendency may be enhanced if the secondary air, which is supplied at restricted throat 12, in the manner to be described below, imparts a rotary movement to the combustion gases.

The combustion gases are exhausted at the upper end of the furnace through an annular passage 30. This promotes an even flow of the gases through the boiler, and is connected to a gas passage 31, in which further convection or other heat exchange surfaces may be located.

The waste liquor to be burnt is supplied by means of a number of nozzles 32, located in the conical top wall of the lower combustion chamber, and are directed downwards against an annular area of the bottom, surrounding discharge opening 22. Primary combustion air is supplied at two levels, below that of the liquor nozzles, by way of passage ports communicating with plenum chambers 33 and 34, which are individually governed.

The liquor is dehydrated to a suitable solid content, and the air has a high degree of preheating, whereby the combustion of the liquor will largely occur in suspended state.

The arising combustion gases are supplied with secondary air at restricted throat 12 by means of a further plenum chamber 35. The passage ports are arranged in such a manner that a rotating movement is imparted to the gases. Hereby entrained heavier particles, including drops from the pillarlike structure 28, will be carried outwards to the shell of the combustion chamber. A substantial portion of these particles will, in liquid state, flow down along the inclined surface 16 at the lower end of the final combustion chamber, and will in this manner be carried back to the lower combustion chamber.

Access to the furnace for survey and repair, when the boiler has been shut down is by way of an opening 37. The inclined top wall of the lower combustion chamber forms a good protection against lumps of deposits falling from the screen and the superheater, and it is possible, from this protected area, rapidly to erect a shelter at throat 12, whereby work may be performed all over the combustion chamber, without any risk of interference from dropping deposits.

Figure 2:
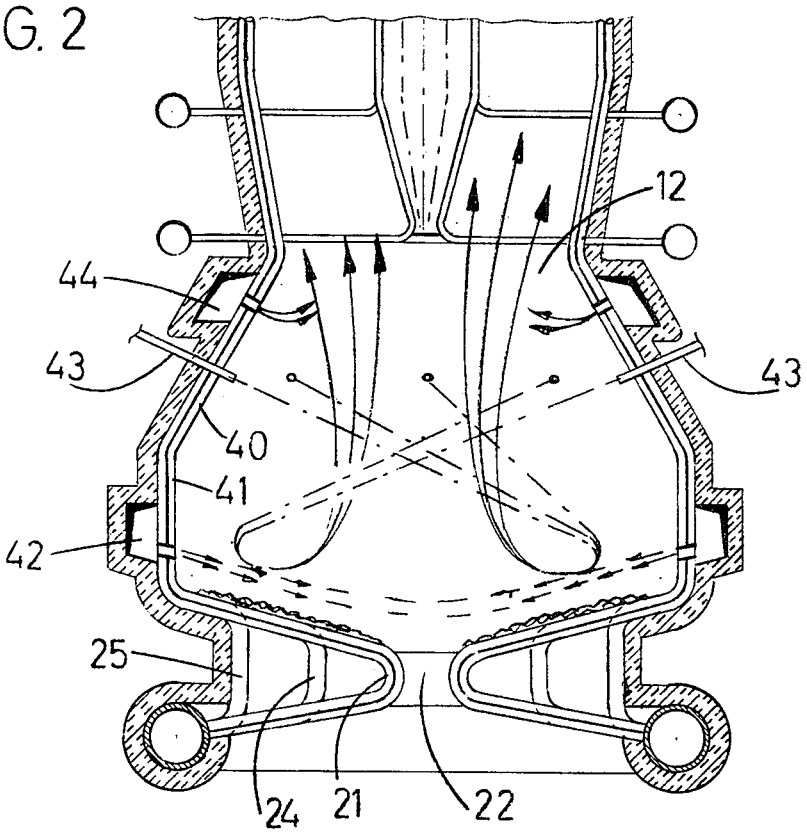
Figure 3:
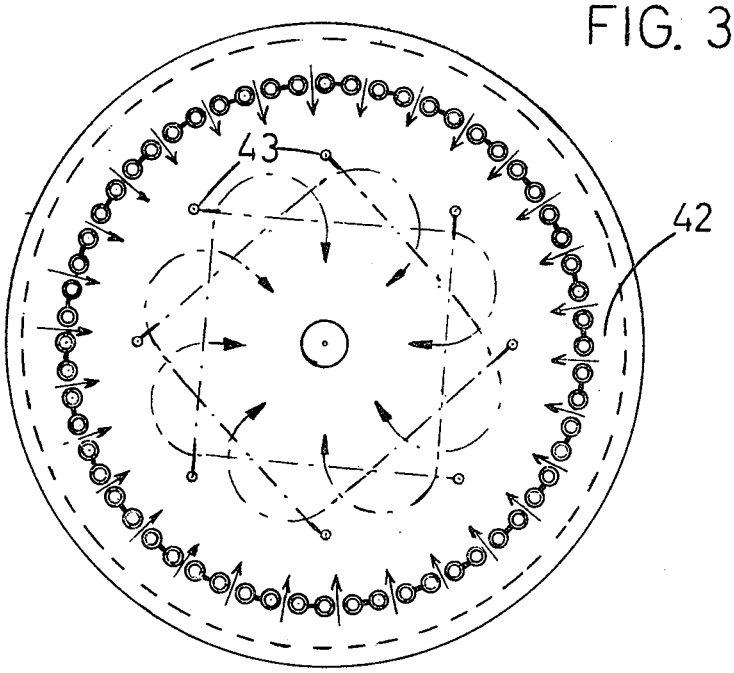

With the modified embodiment shown in FIGS. 2 and 3 only, the upper portion 4 of the envelope wall of the lower combustion chamber is formed as a truncated cone, the lower portion 41 of the wall being cylindrical.

The bottom structure is similar to the one described in connection with FIG. 1, and includes groups of tubes 21, 24, 25 forming a framework, and defining a discharge opening 22.

Primary combustion air is here supplied by ports communicating with a plenum chamber 42, and directing jets of air radially inwards, a short distance above the bottom of the furnace chamber.

The liquor supplying nozzles 43 are located in the inclined portion of the envelope wall, and direct jets of liquor obliquely downwards, tangentially with respect to an imaginary, annular surface, concentric with discharge opening 22. The liquor droplets will be carried by the primary air, and will be burnt in suspended state.

The final combustion is brought about by means of secondary air, which in the manner described in connection with FIG. 1, is supplied from a plenum chamber 44 at restricted throat 12.

Figure 4:
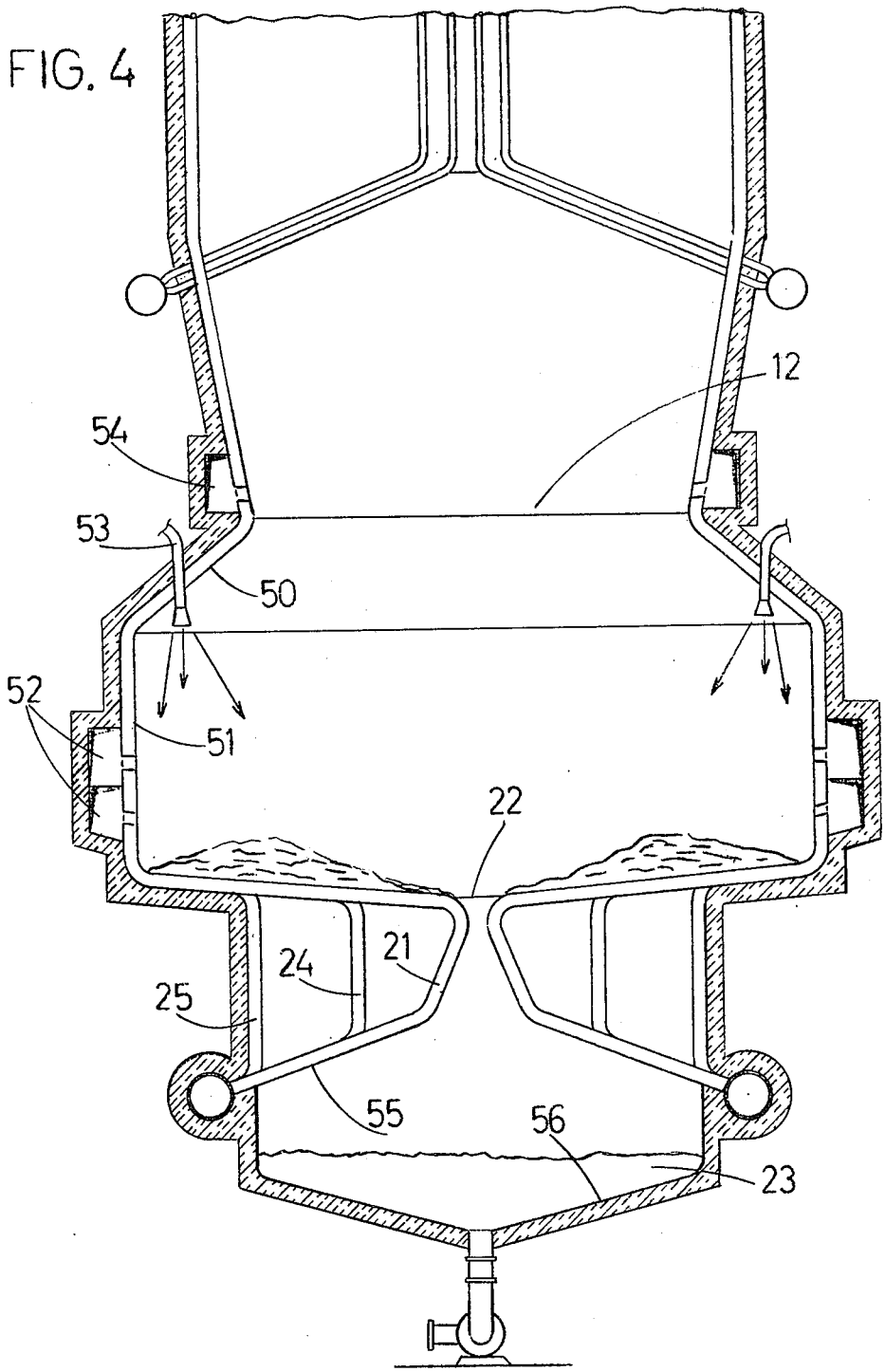
FIG. 4 shows the lower portion of a furnace of a further modified design.

With the embodiment according to FIG. 4 the upper, truncated conical portion 50 of the combustion chamber is comparatively short in the axial direction of the chamber, but the top angle is bigger than with the previously described embodiments. The cylindrical portion 51 will instead occupy a bigger part of the chamber.

Primary air is supplied from a plenum chamber 52. The liquor nozzles 53 are located in the inclined portion 50 of the wall, and secondary air is supplied from a plenum chamber 54 at restricted throat 12. Tubes 21, 24 and 25 constituting the bottom structure are here designed to form also the roof 55 of dissolving tank 23. The walls and bottom 56 thereof are in a conventional manner manufactured from steel plate, or from concrete, and may be suspended from the boiler structure, or be supported by pillars.

The embodiments shown are examples only, and the components thereof may be varied in many ways within the scope of the appended claims, depending upon the type of fuel to be burnt and the load upon the boiler. It is evident that the shell, instead of having a purely cylindrical cross section, may be built up of a number of plane membrane sections, interconnected to each other angularly whereby a polygon inscribed in, or circumscribing a circle is formed.

What I claim is:

1. A plant for burning fuels which produce a liquid combustion residue, which plant includes a furnace having a basically circular cross section and a vertical axis, and being defined by a tube-membrane shell formed by water cooled tubes interconnected by welded fins, the improvement of a lower furnace chamber being upwardly defined by a truncated conical surface an upper final combustion chamber, aligned with said lower combustion chamber and being downwardly defined by a reversed, truncated conical surface, a restricted gas passage formed by the merging of said truncated conical surface and said reversed, truncated conical surface, a bottom structure in said lower combustion chamber formed by tubes of said shell membrane being bent radially inwards, a discharge opening, located centrally in said bottom and formed by some of said radially directed tubes being further bent back towards said shell and a screen of tubes within said final combustion chamber, just upstream of said restricted gas passage, the tubes of said screen being sparse along the shell of the final combustion chamber, but very close together in the centre thereof, just above the discharge opening, nozzles for the supply of final combustion air being located adjacent to the restricted gas passage and arranged to impart a forceful rotary movement to the arising gases.

2. The plant according to claim 1 in which an annular distribution header for the tubes of the membrane shell is located below the bottom of the lower furnace chamber, a first group of tubes extending radially inwards from the distribution header towards the centre of the chamber bottom and bent substantially in 180°, so they, by their bent portions, will define said discharge opening and outside the latter form a framework for said bottom structure, and in which at least one further group of tubes is arranged so the tubes thereof will project between the tubes of the first group, and likewise are bent substantially in 180°, but at a bigger radial distance from the centre of the furnace than the bends of the tubes of the first group, the tubes of all groups, at the perimeter of the bottom structure being bent upwards to form part of the tube shell.

3. The plant according to claim 2, in which the discharge opening is adapted to transfer the liquid combustion residues directly into a dissolving tank located below the bottom of the combustion chamber.

4. A plant for burning fuels which produces a liquid combustion residue, which plant includes a furnace having a basically circular cross section and a vertical axis, and being defined by a tube-membrane shell formed by water cooled tubes interconnected by welded fins, the improvement of, a lower furnace chamber being upwardly defined by a truncated conical surface, an upper final combustion chamber, aligned with said lower combustion chamber and being downwardly defined by a reversed, truncated conical surface, a restricted gas passage formed by the merging of said truncated conical surface and said reversed, truncated conical surface, a bottom structure in said lower combustion chamber formed by tubes of said shell membrane being bent radially inwards, to form a mainly horizontal surface, a discharge opening, located centrally in said bottom structure and formed by some of said radially directed tubes being further bent back towards said shell, nozzles for spraying waste liquor into the furnace, evenly spaced along the perimeter of the lower combustion chamber, and so located in the tube shell thereof, that they will direct jets of waste liquor droplets against an annular portion of the furnace bottom surface, outside of said discharge opening, and openings for the supply of primary air located in said lower combustion chamber at a lower level than the liquor introducing nozzles, said nozzles, and said openings, being formed to maintain the body of burning liquor droplets in a suspended, rotary movement.

5. The plant according to claim 4, in which the openings for the supply of primary combustion air are adapted to direct jets of air radially inwards, towards the centre of the combustion chamber, whereas the liquor introducing nozzles are adapted to direct jets obliquely downwards, tangentially with respect to a circular line, being concentric with the centre of the furnace.

* * * * *